United States Patent [19]

Knopp

[11] Patent Number: 5,009,143

[45] Date of Patent: Apr. 23, 1991

[54] EIGENVECTOR SYNTHESIZER

[76] Inventor: John V. Knopp, 10407 SE. 174th Apt. 1207, Renton, Wash. 98055

[21] Appl. No.: 456,063

[22] Filed: Dec. 26, 1989

Related U.S. Application Data

[63] Continuation of Ser. No. 42,109, Apr. 22, 1987, abandoned.

[51] Int. Cl.[5] ..... G10H 1/08; G10H 7/02

[52] U.S. Cl. ..... 84/604; 84/625

[58] Field of Search ..... 84/601-608, 84/622-625, 659-661, 692-700, 735, 736; 364/718; 381/51-53

[56] References Cited

U.S. PATENT DOCUMENTS

| | | | |
|---|---|---|---|
| 3,823,390 | 7/1974 | Tomisawa et al. | 84/1.01 X |
| 3,982,070 | 9/1976 | Flanagan | 381/51 |
| 4,163,120 | 7/1979 | Baumwolspiner | 381/51 |
| 4,326,260 | 4/1982 | Gross | 364/718 |
| 4,466,325 | 8/1984 | Takauji | 84/1.22 |
| 4,549,459 | 10/1985 | Deutsch | 84/1.22 X |
| 4,700,603 | 10/1987 | Takauji et al. | 84/1.23 X |
| 4,707,858 | 11/1987 | Fette | 381/39 X |
| 4,716,414 | 12/1987 | Luttrell et al. | 356/4.5 X |

*Primary Examiner*—Stanley J. Witkowski

[57] ABSTRACT

An eigenvector synthesizer is provided for producing a wide range of musical sounds using a subset of eigenvectors of related sounds. The waveshapes of the eigenvectors can be scaled and summed to provide an accurate reproduction of the related sounds. With an astute selection of related sounds, an accurate reproduction of a wide range of musical sounds can be provided with a minimum amount of memory and a minimum number of calculations.

11 Claims, 7 Drawing Sheets

FIG. 2a Mean
FIG. 2b 1st ev
FIG. 2c 2nd ev
FIG. 2d 3rd ev
Normalized Amplitude
Harmonic Number
1
0
-1
1 2 3 4 5 6 7 8 9 10 11 12 13 14 15 16
3
4
5
6

EIGENVECTOR SYNTHESIZER

This application is a continuation of application Ser. No. 042,109, filed Apr. 22, 1987, and now abandoned.

BACKGROUND OF THE INVENTION

Various digital techniques have been used to generate musical sounds. One of the earlier techniques was the sampling of a waveshape stored in a read only memory, disclosed in U.S. Pat. No. 3,515,792. This technique allows a good approximation of a steady state musical sound but lacks flexibility in the attack and decay segments. In addition, for the case where the spectral components of a single instrument vary with frequency, a large number of waveshapes must be stored.

The Fourier component synthesizer overcomes the problems of the waveshape synthesizer by being able to completely specify the spectral components of a sound, disclosed in U.S. Pat. No. 3,809,786. The main drawback to the Fourier component synthesizer is the large number of calculations necessary to generate a single musical sound, e.g., a trompette stop would require at least the generation of 16 harmonic amplitudes.

The technique described in this patent overcomes the approach of a waveshape synthesizer and the Fourier synthesizer by using a collection of eigenvector sets which have been generated from a related group of sounds. A group may be either a sound of a single instrument over its total frequency range and its attack and decay or several instruments with similar harmonic characteristics.

SUMMARY OF THE INVENTION

The generation of an output sound, say a single trumpet can be obtained by the addition of a special set of waveshapes which are generated from a related set of sounds. The waveshapes may be either:

1. A subset of eigenvectors of the waveshapes of the related sounds.
2. The waveshapes associated with a subset of eigenvectors of the spectra of the related sounds.

The related sounds may be a group of instruments with similar spectra and their voicing, attack, decay and steady state variations.

Different scaling of the eigenvectors can be used to reproduce all the related sounds used to generate the eigenvector basis. With proper selection of the related sounds, the number of eigenvectors needed to reproduce all the sounds in the group is less than the number of sounds in the group: i.e., a subset of eigenvectors.

The generation of eigenvectors, also referred to as principle components and characteristic vectors, starts with the selection of a group of related sounds. The related sounds may be represented in either the time domain or frequency domain. For this discussion the eigenvector basis of the frequency domain will be developed.

After the spectra of the sounds are generated a covariance matrix of the spectra is calculated. The covariance matrix is a n by n matrix where n is the number of harmonics in the spectra. Note, for phase consideration the matrix would be $2n$ by $2n$. The i,j element of the covariance matrix is defined as $$C_{ij} = \sum_{k=1}^{m} (H_{ik} - \overline{H}) * (H_{jk} - \overline{H}_j),$$

where m sounds are present, $H_{ik}$ is the ith harmonic amplitude of the kth sound and $\overline{H}_i$ is the mean of the ith harmonic amplitude.

The set of vectors which reduce the covariance matrix to a diagonal form is an eigenvector basis:

$$\lambda = E^* c^* E^{-1},$$

where λ is a diagonal matrix of the eigenvalues, E is the eigenvector matrix, and c is the covariance matrix. The eigenvectors set consists of n orthonormal vectors with n elements.

Since together, the n eigenvectors span the n dimensional space, the eigenvector basis can be used to generate any n dimenional vector. For all but pathological cases, fewer than n vectors are needed to accurately reproduce the original spectra. For the group of similar spectra used to generate the covariance matrix, the importance of each eigenvector is related to its eigenvalue. The ratio of an eigenvalue to the sum of the eigenvalues gives the amount of variation explained by the associated eigenvector.

Two different approaches are possible in using the eigenvector technique:

1. All spectra present in the sounds which are to be reproduced may be combined to form one eigenvector set. Note, an eigenvector set will denote the number of eigenvectors needed to faithfully reproduce the related sounds used to generate the eigenvector set.
2. Related spectra can be used to generate multiple eigenvector sets.

For the first approach, only one set of eigenvectors is needed to reproduce all sounds of interest. For example, all the sounds of a pipe organ can be reproduced by using a mean vector and 7 or more eigenvectors. The number of vectors depends on the number of harmonics used in the spectra, whether phase information is included and how accurate the sounds are produced.

For the second approach the sounds are grouped into related sounds and multiple sets of eigenvectors are generated. By judicial grouping of sounds, the second approach can reproduce accurate sounds by using only a mean vector and 3 eigenvectors for each set.

The first approach uses less memory for storing eigenvectors but has the disadvantage of requiring more calculations to generate each sound. The second approach uses more memory for storing eigenvectors but has the advantage of requiring fewer calculations. For the remainder of this paper, the second approach will be assumed.

FIG. 1 shows the characteristic harmonic expansion for a Trompette stop between C, 3 octaves above middle C (2093Hz) 1 ) and C, 3 octaves below middle C (32.7Hz) 2 at ¼ octave increments. The main difference among these spectra is that the lower notes are much richer in higher harmonics. Only the first 16 harmonics are shown and no phase information is assumed.

When the eigenvector set is generated for the curves shown in FIG. 1, the 3 most significant eigenvectors account for 98.7% of all the variation about the mean vector; see FIGS. 2*a–d* for the spectra of the mean vector 3, the first eigenvector 4, the second eigenvector 5 and the third eigenvector 6. A fair representation of the 25 spectra shown in FIG. 1 can be obtained by using a mean vector and the first 3 eigenvectors. Note, due to the harmonic richness of the Trompette stop, two or more eigenvector sets of 3 eigenvectors might be needed to obtain a good representation of the Trompette stop over the total frequency range.

The scalar multiplier for a given spectrum is obtained by the equation:

$$A_i = \sum_{k=1}^{n} (H_{ik} - \overline{H}_k) * E_{ik},$$

where $A_i$ is the scalar multiplier associated with the ith eigenvector, $H_{ik}$ is the amplitude of the kth harmonic of the reference spectrum, $\overline{H}_k$ is the mean vector for the kth harmonic and $E_{ik}$ is the kth element of the ith eigenvector.

FIG. 3 shows the scalar multipliers associated with the first eigenvector 7, the second eigenvector 8 and the third eigenvector 9 for the 25 spectra shown in FIG. 1. Although only the spectra for every ¼ octave is used in the generation of the eigenvector set, the scalar multipliers for every note can be obtained by linear interpolation.

The mean vector and eigenvectors are in the frequency domain and must be converted to time domain functions for generating an output sound. The output waveshape equals the sum of the mean vector waveshape and the scaled eigenvector waveshapes:

$$\text{output}(i) = \text{mean}(i) + \sum_{k=1}^{4} A_k * e_{ik},$$

where output(i) is the ith position on the output waveshape, mean(i) is the ith position on the mean waveshape and $e_{ik}$ is the ith position on the kth eigenvector waveshape. Note, the mean vector and eigenvector have been transformed from the frequency to the time domain.

In FIG. 4, the waveshape for one cycle of a C4 Trompette stop 10 is shown with the waveshapes of the mean vector 11, the mean vector plus the scaled first eigenvector 12, the mean vector plus the scaled first and second eigenvectors 13 and the mean vector plus the scaled first 3 eigenvectors 14. For ease of viewing, the waveshapes have been normalized to give a maximum amplitute of 1. As each successive scaled eigenvector is added to the waveshape, the waveshape provides a better approximation to the actual C4 waveshape.

DESCRIPTION OF THE PREFERRED EMBODIMENT

The timing and numerical values used in this description are for illustration purposes only and should not be construed as a limitation of the eigenvector technique or the patent.

There is a tradeoff between the maximum number of musical sounds which can be played simultaneously and the sampling rate. The tradeoff is dependent upon the speed of the digital logic employed and the amount of parallelism used.

For the unit described in this paper the maximum number of sounds is assumed to be 32 and the sampling rate is assumed to be 31.25KHz. This device should allow for a piano and several instruments to be synthesized simultaneously. Four of the devices connected together should allow a classical pipe organ or a medium size orchestra to be duplicated real time.

For a sampling rate of 31.25KHz, a DAC cycle would be 32 microseconds. For 32 instrument sounds, an instrument cycle would be 1.0 microseconds. For four eigenvectors for instrument, an eigenvector cycle would be 250.0 nanoseconds. Note, for ease of discussion, the mean vector will be considered as an eigenvector. Thus the four eigenvectors are actually the mean vector plus the three most significant eigenvectors.

Figure 1:
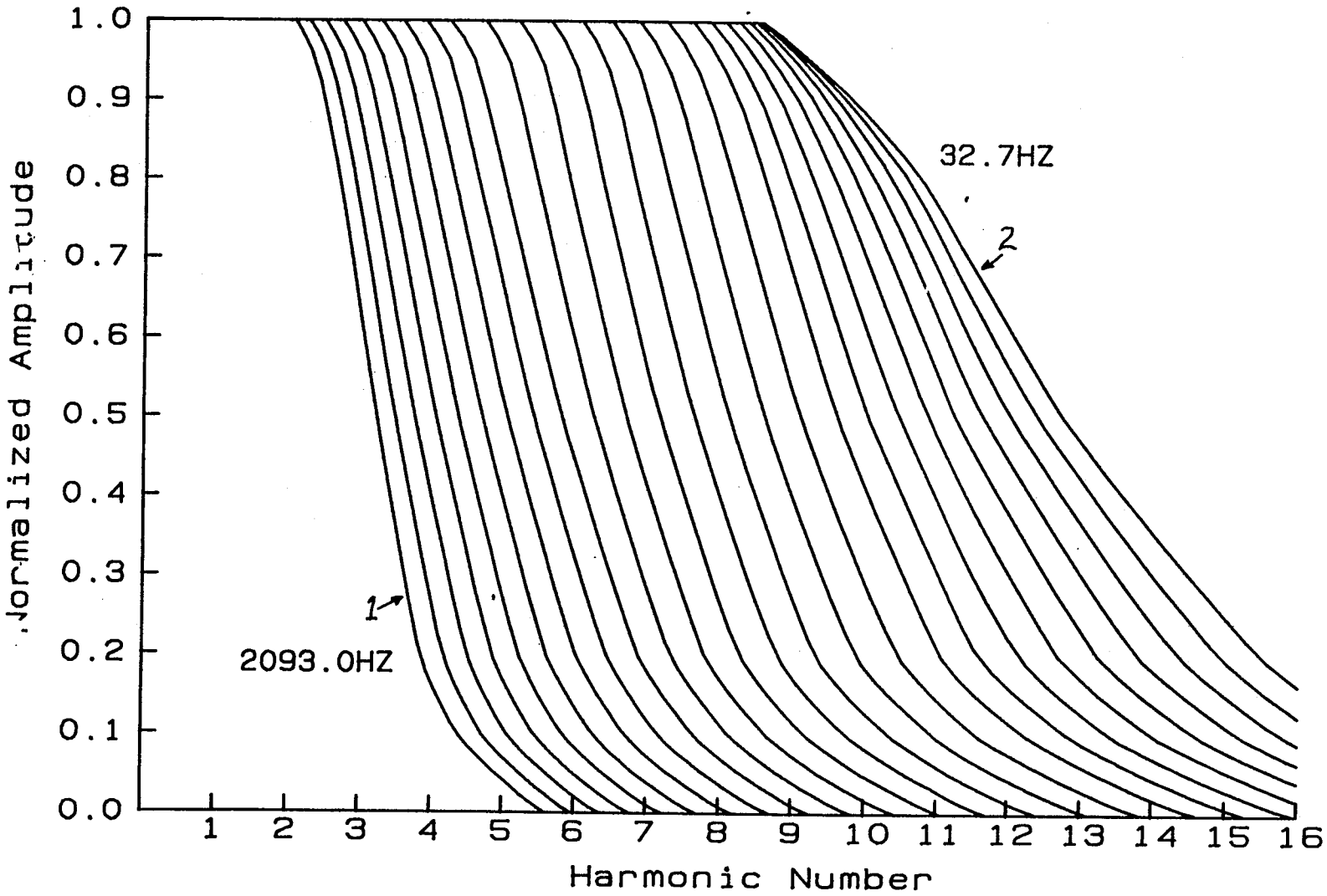
FIG. 1 is a plot of the typical harmonic spectra of 25 trompette between C, 3 octaves above middle C, and C, 3 octaves below middle C, at ¼ octave increments.
Figure 2:
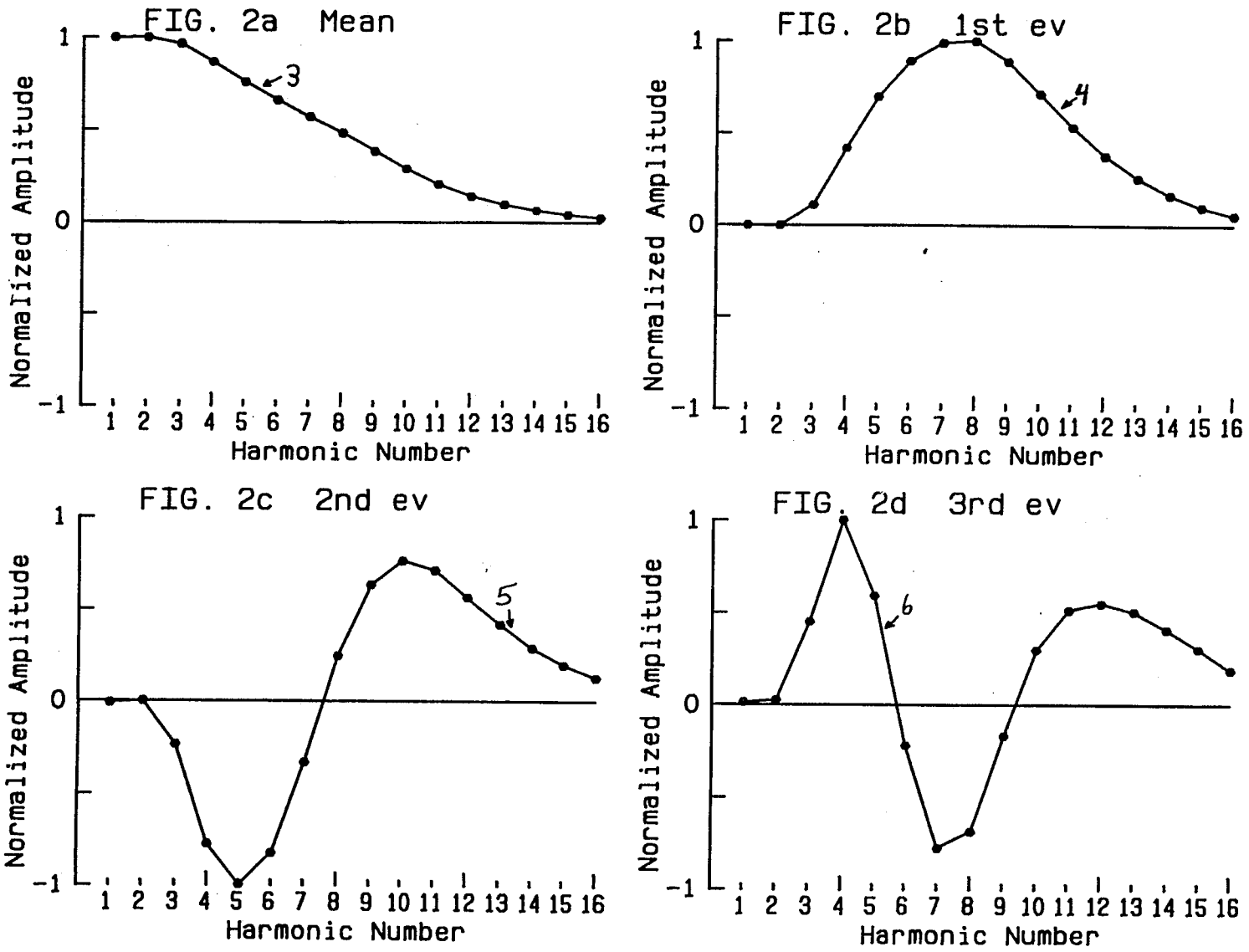
FIGS. 2*a–d* are plots of the mean vector and the 3 most significant eigenvectors of the 25 Trompette spectra shown in FIG. 1.
Figure 3:
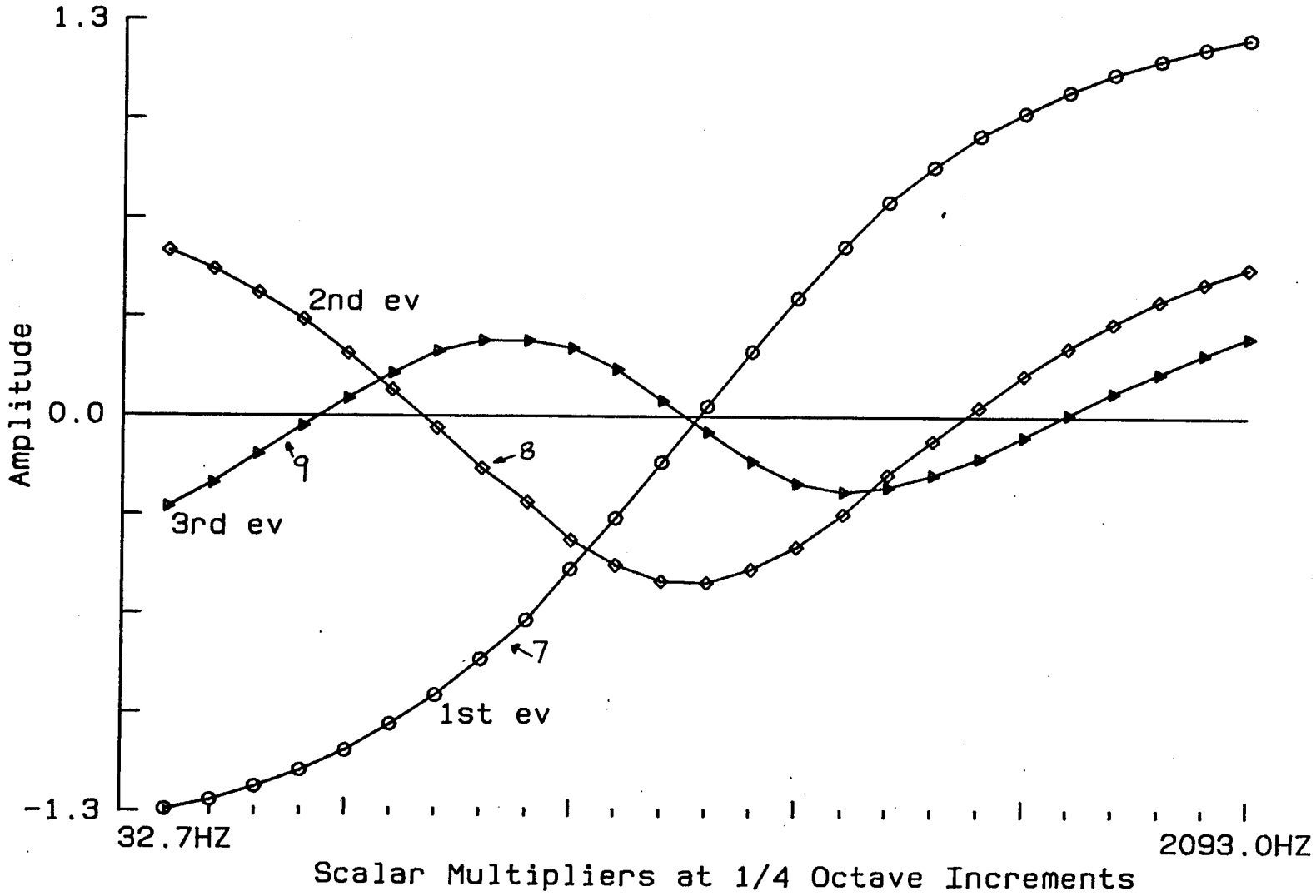
FIG. 3 is a plot of the scalar multipliers associated with the 3 most significant eigenvectors for the 25 Trompette spectra shown in FIG. 1.
Figure 4:
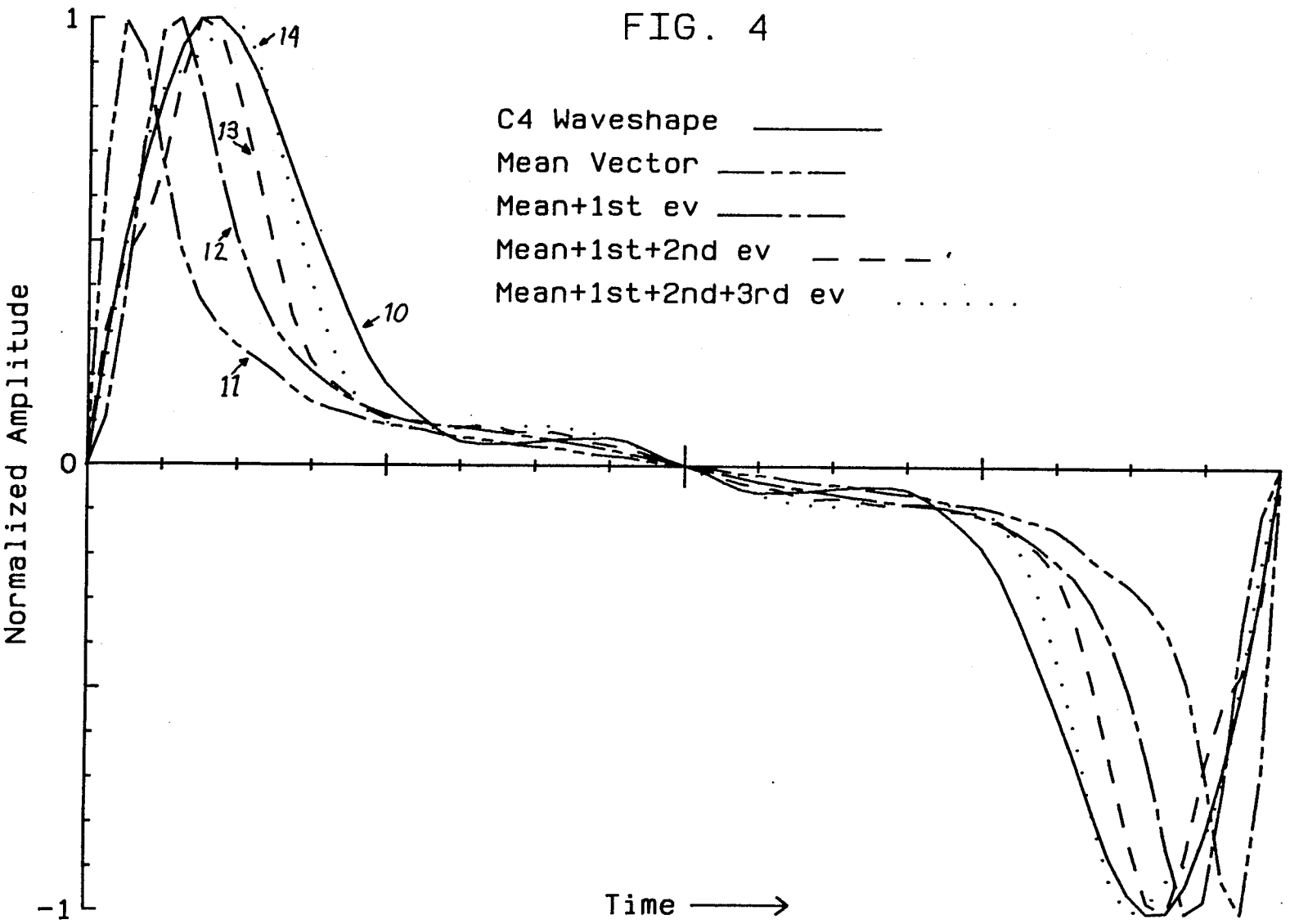
FIG. 4 is a comparison of the actual C4 Trompette stop waveshape and the approximation provided by the waveshapes of the mean vector, the mean vector plus the most significant scaled eigenvector, the mean vector plus the two most significant scaled eigenvectors and the mean vector plus the three most significant scaled eigenvectors.
Figure 5:
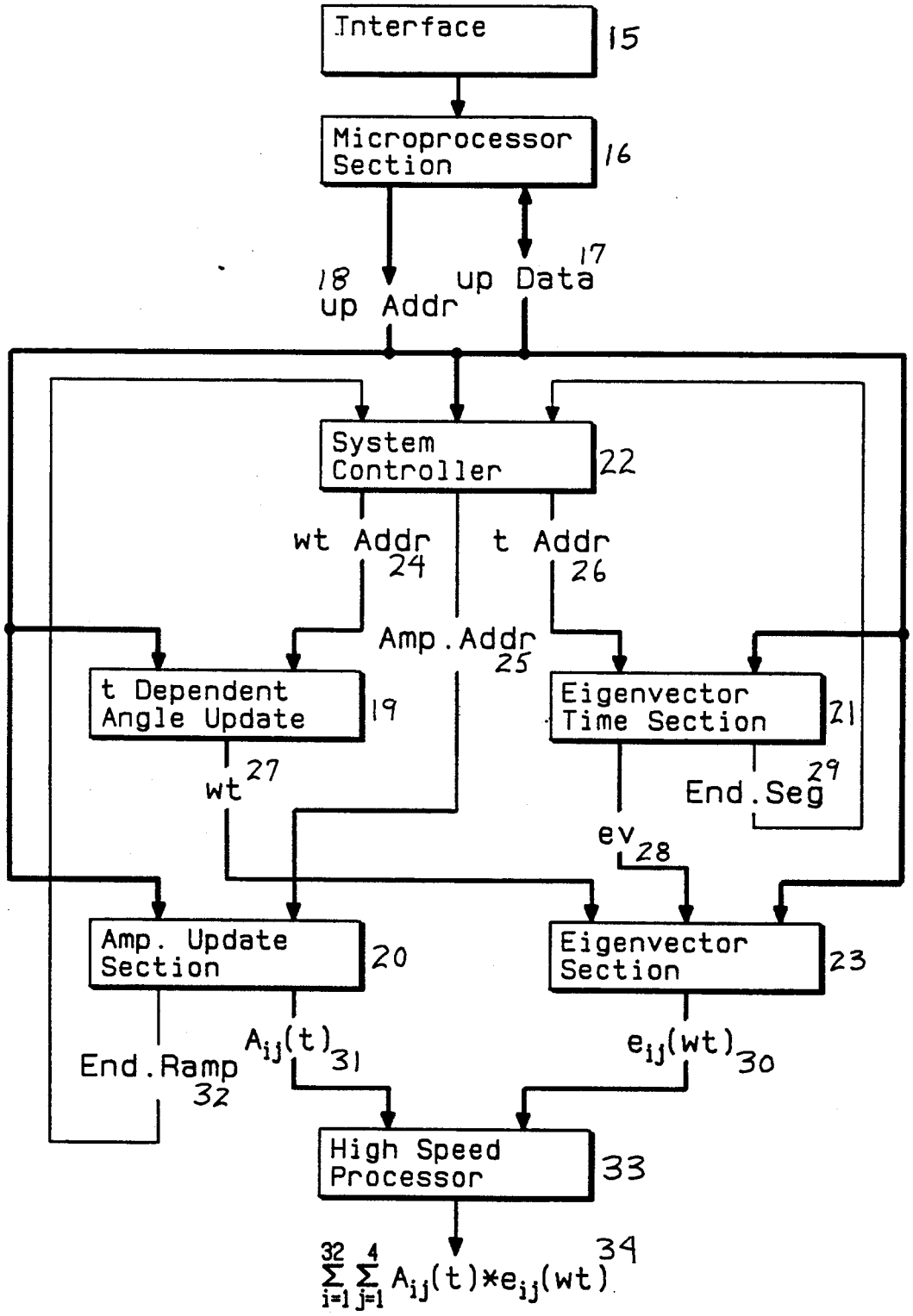
FIG. 5 is a block diagram of how an eigenvector synthesizer might be implemented.

In FIG. 5 a block diagram of a synthesizer based on an eigenvector technique is shown. The overview shown in FIG. 5 is not the only way an eigenvector technique can be used to synthesize musical sound, but an example of how an eigenvector machine might be built.

The interface 15 might be a keyboard or some other mechanical device, an interface to a computer or both types of inputs. The minimum input data through the interface would specify the start time, type of sound, frequency and duration or end of a musical sound. For a keyboard the interface would specify the start of a sound, the type of sound, the frequency of a sound, the end of a sound and possible the amplitude of the sound. The attack, steady state and decay functions would be stored in the microprocessor section 16.

For a computer interface, the input data might be the same as for a keyboard or might include the attack, steady state and decay profiles. For the former case the attack, steady state and decay profiles would have to be stored in the microprocessor section 16.

Here and throughout the remainder of the description of the synthesizer, when something is said to happen and no actuating control lines or signals are shown or mentioned, it is to be assumed that they come form the system controller section. Only rarely will connections to the controller section be mentioned explicitly.

The microprocessor 16 converts the interface data to a form which can be used by the time dependent angles 19 for addressing positions on eigenvector waveshapes as a function of time amplitude update (scalar multiplier) data 20, eigenvector timing 21, system controlling data 22 and eigenvector waveshapes 23. The addressing of the sections are controlled by up address 18 and the data transferred are up data 17. For a pipe organ or dedicated synthesizer, the eigenvector waveshapes might be stored in read only memories in which case, and the address bus 18 and the data bus 17 would not be connected to the eigenvector section 23.

Figure 6:
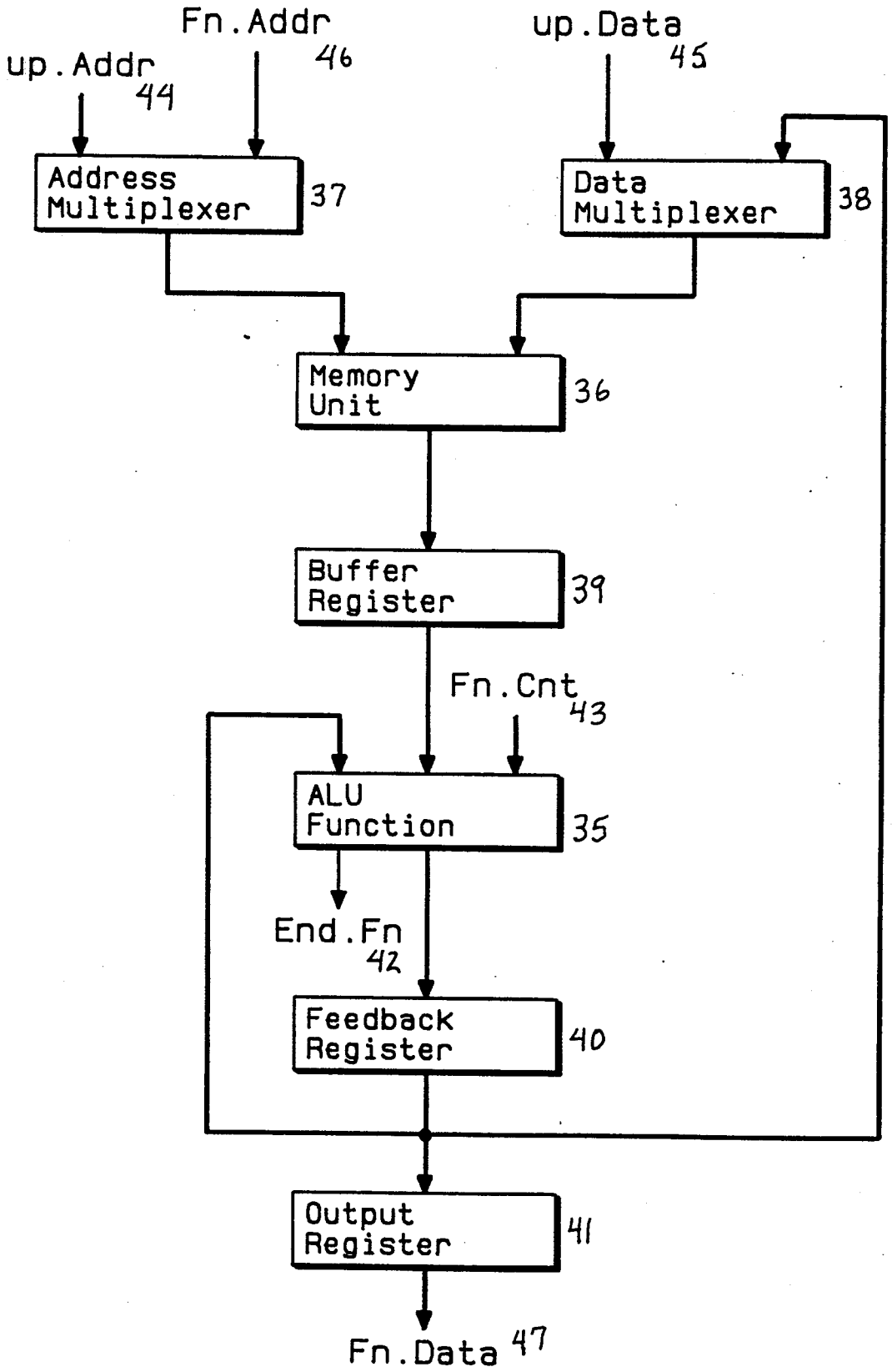
FIG. 6 is a block diagram of a special purpose processor which could be used for the eigenvector time section, the t dependent angle update section and the amplitude update section shown in FIG. 5.

The system controller 22 generates wt address 24, amplitude address 25 and time address 26 for the time dependent angle update section 19, amplitude update section 20 and the eigenvector time section 21 respectively at a 4 MHZ rate, one eigenvector cycle. The eigenvector time section 21, the time dependent angle section 19 and the amplitude update section 20 provide segment timing, frequency information and scalar multiplier data respectively. These functions will be discussed later. Although the logic needed in each of the above sections are somewhat different, the 3 sections can be implemented using the same logic as shown in FIG. 6. Using the same logic for the 3 sections will not only reduce the design time and debugging time, but if custom chips are used, would reduce the manufacturing cost.

The time depentent angle section 19 generates a time depentent angle, wt 27 for each eigenvector cycle. The address for the eigenvector section 23 is composed of wt 27 and eigenvector set and number, ev 28. A new address to the eigenvector section 23 is provided every 250ns or once an eigenvector cycle. Note, for most cases the value of wt 27 will be the same for all four eigenvectors in an eigenvector set.

In addition to containing the eigenvector set and number 28, the eigenvector time section determines the length of a steady state segment of a sound. When the steady state has ended, an end of segment signal 29 is given to the system controller 22. Note, for a keyboard interface some of the times will be determined by the length of time a key is held. In this case, the end of segment would come through the microprocessor 16.

The eigenvector section 23 contains a 16 bit wide memory. The memory may either be a ROM or a RAM. If a ROM is used the eigenvectors would be permanent. If a RAM is used then the eigenvector section must have multiplexers for interfacing to the microprocessor—up address 18 and up data 17.

The size of the memory depends on the number of eigenvectors. Each eigenvector should be at least 2048 words long or 8192 words for each eigenvector set. Thus a 256k word memory would be required for 12 eigenvector sets.

The eigenvector section 23 is addressed by the eigenvector set and number 28 and wt 27. The eigenvector set and number 28 determines which eigenvector set and which eigenvector within a set is selected. The wt signal addresses a position on the eigenvector waveshape. The output of the eigenvector section 23 is the value of an eigenvector waveshape, $e_{ij}$(wt) 30 specified by wt 27 and ev 28.

The amplitude update section 20 provides two outputs: the scalar multipliers, $A_{ij}$ (t) 31 and the end of ramp signal 32. The end of ramp signal 32 tells the system controller 22 when an attack or decay segment has been completed. The amplitude update section will be discussed in more detail when FIG. 6 is explained.

Figure 7:
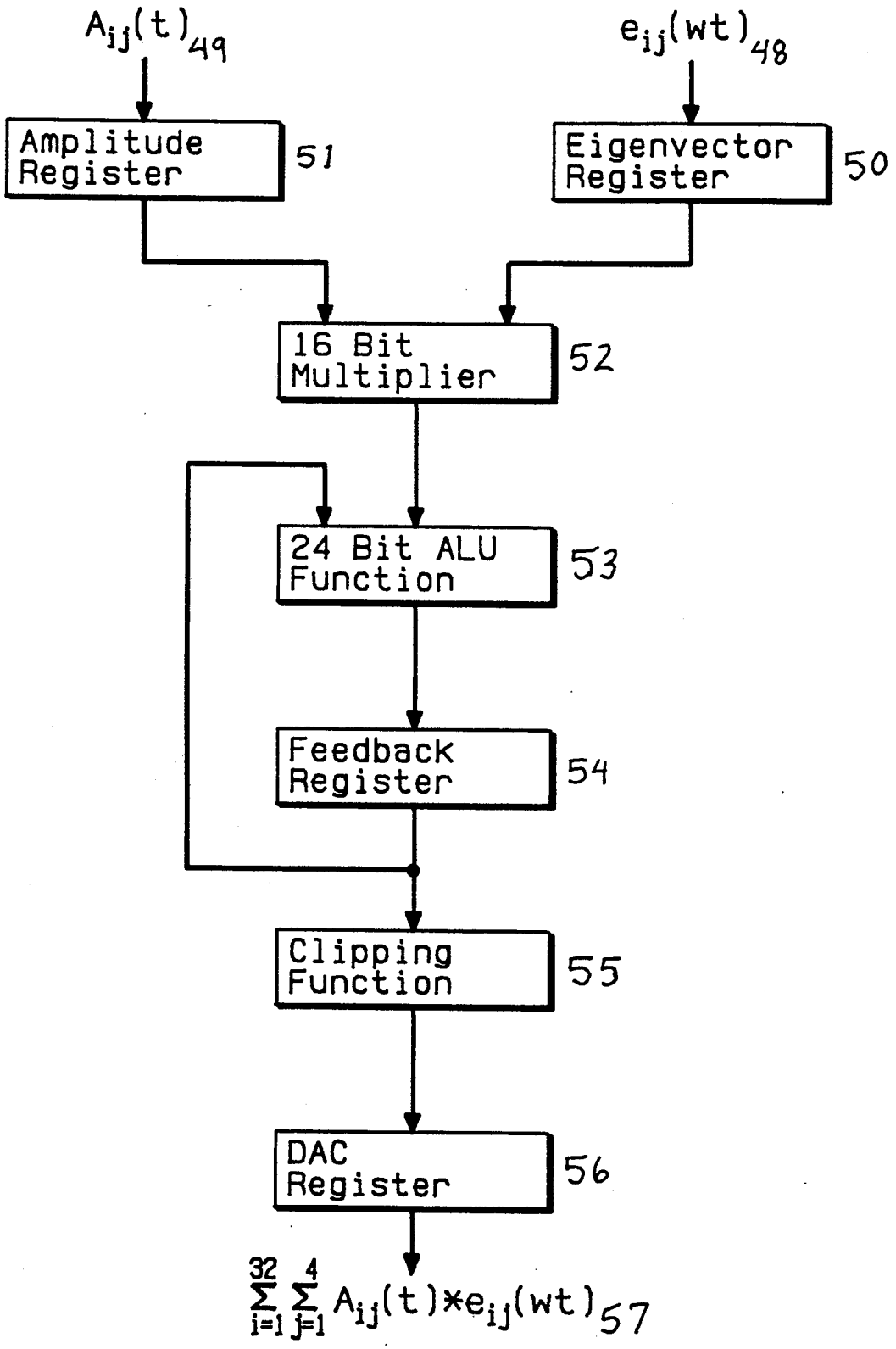
FIG. 7 is a block diagram of how a high speed processor section shown in FIG. 5 might be implemented.

The high speed processor 33 scales the eigenvector waveshape value by multiplying the $A_{ij}$ (t) 31 and $e_{ij}$ (wt) 30 every eigenvector cycle. The product of $A_{ij}$ (t) 31 and $e_{ij}$ (wt) 30 are summed in the high speed processor 33 to generate the digital word which represents the sound at that point in time. The output, $\Sigma A_{ij}(t)*e_{ij}(wt)$ 34 of the high speed processor 33 is converted to an analog signal by a DAC. A more detailed explanation of the high speed processor will be given when FIG. 7 is discussed.

As mentioned previously, the time dependent angle section 19, the eigenvector time section 21 and the amplitude update section 20 share a similar structure and can be implemented using the logic shown in FIG. 6. Using the same logic for the 3 sections will not only reduce the design time and debugging time, but if custom chips are used, will reduce the manufacturing cost.

The general logic is a special purpose processor with a 16 bit ALU 35, a memory 36, an address multiplexer 37, a data multiplexer 38 and registers 39, 40 and 41. From a programming standpoint, the special purpose processor shown in FIG. 6, consists of two nested loops. The outer loop consists of the 128 operations for each DAC cycle; one operation for each eigenvector sounds. Remember there are 32 eigenvector sets, instruments with 4 eigenvectors in each set. The cycle time for each operation in the outer loop is 250.0 nanoseconds.

The inner loop consists of 4 operations with one of the operation reserved for writing to the memory from the microprocessor section 16. The other 3 operations depend upon the particular section and will be discussed later. The cycle time for each operation in the inner loop is 62.5 nanoseconds.

Obviously, in order for the microprocessor 16 to write to the memories in the 3 sections, the microprocessor cycle time must be synchronized with an instrument cycle, 250.0 nanoseconds. Further, the memory of the 3 sections must appear in the memory map of the microprocessor or some type of memory buffer must be employed.

The eigenvector time section 21 preforms two functions: it times the steady state length of an instrument eigenvector and it specifies the eigenvector set number used for the instrument. The four inner loop cycles for the eigenvector time section 21 are given in table 1. During the first cycle the (eigenvector set number)/(eigenvector number) is read from memory 36. Note for most cases, the eigenvector set number will be the same for all four eigenvectors in a set and the eigenvector number will be in sequence, however this is not a restriction. During sequential cycles, the (eigenvector set number)/(eigenvector number), ev 28 is transfer through the buffer register 39, the feedback register 40 and output register 41 where it is then transferred to a register in the eigenvector section 23 and together with wt 27 used to address the eigenvector section 23.

During the second cycle, the current time is loaded into the buffer register 39. The current time is in increments of DAC cycles with a maximum length of 2.097 seconds: count of 65>536. The count is entered as 65>536 minus the number of DAC cycles of the length. The count is incremented by 1 in the ALU function 35 each DAC cycle until the carry bit of the ALU 35 changes state, end of function 42 at which time the segment is complete and an interrupt transmitted to the microprocessor 16 for the next segment. Note, the eigenvector time section 21 is only used to time the steady state.

In the 3rd cycle the memory 36 can be addressed by the microprocessor 16 for inputting data for a new segment. Also the time is incremented if the length has not been reached. In the 4th cycle, the new count is transferred to memory 36. In table 1, the function performed in the 4 inner loop cycles are summarized.

TABLE 1

| Cycle | 1st | 2nd | 3rd | 4th |
|---|---|---|---|---|
| Memory I/(O) | (evset) | (t) | up.data | t+1 |
| Buffer Reg. | — | evset | t | — |
| Feedback Reg. | — | — | evset | t+1 |
| Output Reg. | evset' | — | — | evset |
| ALU Function | — | evset | t+1 | — |

Note, each instrument eigenvector has its own count so the eigenvectors in an instrument can have a different amplitude profile over the length of the note. In some cases this might not be necessary, in which case only one of the eigenvectors would have a count and all four eigenvectors of an instrument would change at the same time. This housekeeping would be handled by the microprocessor 16.

The function control 43 determined the operation of the ALU function 35 and is generated in the system controller 22. The up address 44 and up data 45 in FIG. 6 are the same as up address 18 and up data 17 in FIG. 5. The function address 46 in FIG. 6 is wt address 24 for the time dependent angle update 19, amplitude address 25 for the amplitude section 20 and t address 26 for the eigenvector time section 21 shown in FIG. 5. The function data 47 is wt 27 for the time dependent angle update 19, $A_{ij}(t)$ 31 for the amplitude update section 20 and ev 28 for the eigenvector time section 21.

The four cycles for the generation of wt in the time dependent angle section 19 are shown in table 2. In the first cycle the, value of the current wt is loaded into the buffer register 39 from memory 36 and the previous instrument/eigenvector wt 47 is transferred from the output register 41 to the register for addressing the eigenvector section 23.

TABLE 2

| Cycle | 1st | 2nd | 3rd | 4th |
|---|---|---|---|---|
| Memory I/(O) | (wt) | (Δwt) | up.date | wt+Δwt |
| Buffer Reg. | — | wt | Δwt | — |
| Feedback Reg. | — | — | wt | wt+Δwt |
| Output Reg. | wt' | — | — | wt |
| ALU Function | — | wt | wt+Δwt | — |

In the 2nd cycle, the delta wt is loaded into the buffer register 39 and wt is transferred through the ALU 35 to the feedback register 40. In the 3rd cycle, the memory 36 is addressed by the microprocessor 16 if an update is needed and wt is added to delta wt with the results being stored in the feedback register 40. In the 4th cycle, the new wt, wt+Δwt is transferred to memory 36 and to the output register 41.

In most cases the frequency for all four eigenvectors in an instrument will be the same. However there are times when the frequencies of the eigenvectors in an instruments might not be the same. For example a mixture of an organ can be obtained by using different frequencies for each eigenvector. For this special case, each eigenvector would be a waveshape.

The special purpose processor handles only a 16 bit word but wt must be a 28 bit word to provide sufficient accuracy to wt for the lowest frequencies. However since only the 11 msb's are used in addressing the eigenvector section, the 5 lsb's are only important for updating purposes.

A method to obtain a wt accuracy of 28 bits in a 16 bit processor is explained below using 4 delta wt rather than one:

1. Assume a DAC cycle counter with a hexidecimal output of $xxx.
2. When the counter value is $XX$\overline{F}$, an update delta wt1 is used where X means 'does not matter' and $\overline{F}$ means not F.
3. When the counter value is $X$\overline{F}$F, an update delta wt2 is used where X and $\overline{F}$ are the same as above. The update delta wt2 is delta wt1 plus a 4 bit correction. Note, since the correction is only 4 bits, it can only change wt by the lsb used in addressing the eigenvector section.
4. When the counter value is $$\overline{F}$$FF, an update delta wt3 is used which is delta wt2 plus a four bit correction.
5. when the counter value is $FFF, an update delta wt4 is used which is delta wt3 plus a 4 bit correction.

The value of the four delta wt's are generated in the microprocessor.

The amplitude update section 20 requires two DAC cycles to update an amplitude. During an odd DAC cycle the current amplitudes are updated by delta amplitudes and during an even cycle the current amplitudes are compared to reference amplitudes to determine when the segements are complete.

The procedure for updating an amplitude as shown in table 3 is the same as for wt except the updating is done every other DAC cycle. As with wt, the amplitude is updated with 4 different delta amplitudes to obtain greater accuracy in the ramp rate.

TABLE 3

| Cycle | 1st | 2nd | 3rd | 4th |
|---|---|---|---|---|
| Memory I/(O) | (a) | (Δa) | up.date | a+Δa |
| Buffer Reg. | — | a | Δa | — |
| Feedback Reg. | — | — | a | a+Δa |
| Output Reg. | a' | — | — | a |
| ALU Function | — | a | a+Δa | — |

The procedure for comparing the current amplitude with a reference amplitude has one thing in common with the updating procedure: the current amplitude must be loaded into the output register 41 during the 4th cycle.

In the first cycle of the comparsion cycle, see table 4, the current amplitude is loaded in the buffer register 39 and the amplitude of the last operation must be transferred from the output register 41 to the high speed processor 33. In the second cycle the reference amplitude is transferred to the buffer register 39 and the current amplitude is transferred to the feedback register 40. In the 3rd cycle the microprocessor 16 can write to the memory 36 if a change is required, the current amplitude is compared to the reference but the result of the comparison is not transferred to the feedback register 40.

TABLE 4

| Cycle | 1st | 2nd | 3rd | 4th |
|---|---|---|---|---|
| Memory I/(O) | (a) | (a(ref.) | up.date | — |
| Buffer Reg. | — | a | a(ref.) | — |
| Feedback Reg. | — | — | a | a |
| Output Reg. | a' | — | — | a |
| ALU Function | — | a | compare | — |

The carry of the ALU 35 is outputted on the end-of-function 42 line during the comparison operation. The end-of-function bit 42 is compared to a control bit in the system controller 22 to determine if the reference amplitude has been exceeded. If the reference amplitude has been exceeded then an interrupt is sent to the microprocessor 16 to provide a new stop amplitude.

Returning to the microprocessor section 16, the microprocessor must:

1. Provide updating data to the 3 special purpose processors.
2. Keep track of all active instruments and select locations for new instruments.
3. Monitor the interface for new instruments or the end of an instrument for a keyboard interface 15.
4. Read license plate data in system controller section 22 to determine which instrument sound eigenvector caused an interrupt.
5. Keep track of time to know when to start an instrument. In order for the microprocessor 16 to achieve the above requirements an 8 MHz, 16 bit microprocessor will probably be needed. Assuming an 8 MHz, 16 bit microprocessor is used and that it takes about 500 cycles to start an eigenvector, it would take 250 microseconds to start an instrument sound or 8 milliseconds to start all 32 instruments. This time would be reduced if all eigenvectors in an instrument had the same frequency and amplitude profile.

It is desireable to program the microprocessor to start all four eigenvectors in an instrument without interrupts. Also all frequency data for an instrument should be completed in sequence to minimize phase differences among the eigenvectors. For example, if all four wt are loaded in 10 microseconds the phase difference between the first and last eigenvector would be less than 10 microseconds or less than 45 degrees for a 12KHz frequency.

Actually the phase difference is more dependent upon the DAC cycle. If all four wt's are loaded in the same DAC cycle, then there will be no phase different. If they are loaded in adjacent DAC cycle they will have a time difference of 32 microseconds! One way around this potential problem is to inhibit the wt updating until all four wt's are loaded.

In FIG. 7, the eigenvector data 48 and amplitude data 49 are stored in the eigenvector register 50 and the amplitude register 51 respectively. The delayed eigenvector word 48 and amplitude word 49 are multiplied in the 16 bit multiplier 52, added in the 24 bit ALU 53 to the previous sum of products stored in feedback register 54 and the new sum stored in the feedback register 54. Obviously the sign bit from the 16 bit multiplier 52 must be extended for the 24 bit addition. The contents of the feedback register 54 must be set to zero at the start of a DAC cycle. After all the products for a DAC cycle are summed, the 24 bit word is reduced in the clipping function 55 to a word length that is compatible with the digital to analog converter. The clipping function 55 does two operations:

1. It drops the m lsb's.
2. If the remaining 24-m bits represents a number greater (less) than the DAC can convert, the output is set to the maximum (minimum) number that the DAC can convert.

The size of m depends on the size of the DAC and on how often a clipping of peak values is acceptable. The clipped word is stored in the DAC register 56 until it is ready to be transferred to the DAC.

As stated in the beginning of this description, the numerical values, parameters and logic functions are only one of many ways to produce an eigenvector synthesizer. This description is meant to show one way of implementing an eigenvector synthesizer.

I claim:

1. An eigenvector synthesizer comprising:
(a) means for storing in digital representation multiple eigenvector waveshape sets in which each eigenvector waveshape set has been calculated from a covariance matrix which specifies the interaction among related waveshapes of musical instruments and/or sounds,
(b) means for selecting said eigenvector waveshape sets and eigenvector waveshapes having a time dependent angle within one of said eigenvector waveshape sets,
(c) means for addressing a position on said eigenvector waveshapes with said time dependent angle and thereby obtaining eigenvector waveshape amplitudes,
(d) means for storing in digital representation said time dependent angle,
(e) means for updating said time dependent angle,
(f) means for scaling said eigenvector waveshape amplitudes by multiplying said eigenvector waveshape amplitudes by scalar multipliers and thereby obtaining scaled eigenvector waveshape amplitudes,
(g) means for storing in digital representation said scalar multipliers,
(h) means for selecting said scalar multipliers which are associated with said eigenvector waveshapes,
(i) means for updating said scalar multipliers,
(j) means for summing said scaled eigenvector waveshape amplitudes within one of said eigenvector waveshape sets and thereby producing a signal which can be used to generate a musical sound and,
(k) means for summing said signal with another signal and thereby producing a complex signal which can be used to generate multiple musical sounds.

2. The eigenvector synthesizer according to claim 1 in which the means for producing a signal which can be used to generate a musical sound further comprising:
(a) means for controlling a time duration of said signal with an eigenvector time and thereby controlling a duration of said musical sound,
(b) means for storing in digital representation said eigenvector time,
(c) means for selecting said eigenvector time and,
(d) means for updating said eigenvector time.

3. The eigenvector synthesizer according to claim 1 in which the means of addressing a position on said eigenvector waveshapes to obtain said eigenvector waveshape amplitudes, said eigenvector waveshape amplitudes are digitally represented at a plurality of points.

4. The eigenvector synthesizer according to claim 3 wherein said plurality is sufficiently great as to define complex waveforms.

5. The eigenvector synthesizer according to claim 4 wherein said complex waveforms when scaled and summed within one of said eigenvector waveshape sets, said plurality is sufficiently great as to define a complex musical waveform.

6. The eigenvector synthesizer according to claim 1 in which the means for selecting said scalar multipliers, said scalar multipliers are represented as digital words.

7. The eigenvector synthesizer according to claim 6 further comprising:

(a) means for updating said digital words at repetitive rates by adding or subtracting increment words and thereby obtaining updated digital words, (b) means for comparing said updated digital words to reference words and thereby transferring end-of-ramp signals to a system controller when said updated digital words equal or exceed said reference words, (c) means for changing said reference words, said digital words and said increment words by a microprocessor and, (d) means for reading said digital words.

8. The eigenvector synthesizer according to claim 1 in which the means for storing in digital representation said time dependent angle wherein said time dependent angle is represented as a digital word.

9. The eigenvector synthesizer according to claim 8 further comprising:

(a) means for updating said digital word at a repetitive rate by adding an increment word, (b) means for changing said digital word and said increment word and, (c) means for reading said digital word and providing a partial address for said eigenvector waveshapes.

10. The eigenvector synthesizer according to claim 2 in which the means for storing in digital representation said eigenvector time wherein said eigenvector time is represented as a digital word.

11. The eigenvector synthesizer according to claim 10 further comprising:

(a) means for updating said digital word at a repetitive rate by adding an increment word, (b) means for changing said digital word and said increment word, (c) means for detecting when said eigenvector time reaches an end time and, (d) means for transferring an end-of-time signal to said system controller when said end time has been obtained.

* * * * *